US011268787B1

(12) United States Patent
Bernkrant et al.

(10) Patent No.: US 11,268,787 B1
(45) Date of Patent: Mar. 8, 2022

(54) FAST ACQUIRING GUN SIGHT

(71) Applicants: Keith Bernkrant, Cocoa, FL (US); Chen Chang, Chongqing (CN)

(72) Inventors: Keith Bernkrant, Cocoa, FL (US); Chen Chang, Chongqing (CN)

( * ) Notice: Subject to any disclaimer, the term of this patent is extended or adjusted under 35 U.S.C. 154(b) by 0 days.

(21) Appl. No.: 17/237,347

(22) Filed: Apr. 22, 2021

Related U.S. Application Data

(60) Provisional application No. 63/105,131, filed on Oct. 23, 2020.

(51) Int. Cl.
*F41G 1/34* (2006.01)
*F41G 1/17* (2006.01)
*F41G 1/14* (2006.01)

(52) U.S. Cl.
CPC ..... *F41G 1/345* (2013.01); *F41G 1/14* (2013.01); *F41G 1/17* (2013.01)

(58) Field of Classification Search
CPC ..... F41G 1/00; F41G 1/35; F41G 1/30; F41G 1/01; F41G 1/32; F41G 1/34; F41G 1/345; F41G 11/003
USPC ..... 42/114, 111, 113, 132
See application file for complete search history.

(56) References Cited

U.S. PATENT DOCUMENTS

| | | | | |
|---|---|---|---|---|
| 5,735,070 | A * | 4/1998 | Vasquez | F41A 9/62 42/1.02 |
| 10,088,275 | B1 * | 10/2018 | Warren | F41G 1/345 |
| 10,969,197 | B2 * | 4/2021 | Theisinger | F41G 1/345 |
| 2016/0091281 | A1 * | 3/2016 | Gwillim, Jr. | F41G 1/345 42/111 |
| 2017/0016697 | A1 * | 1/2017 | Jones | F41G 1/345 |
| 2018/0172399 | A1 * | 6/2018 | Benzion | F41G 1/10 |
| 2019/0107368 | A1 * | 4/2019 | Benzion | F41G 1/10 |
| 2019/0360777 | A1 * | 11/2019 | Grace | F41G 1/065 |

* cited by examiner

*Primary Examiner* — John Cooper
(74) *Attorney, Agent, or Firm* — Lowndes, Drosdick, Doster; Stephen C. Thomas

(57) ABSTRACT

A sighting system comprising light-emitting rear sighting indicators in which a set of rear sighting indicators disposed on or near the hammer end of a firearm, and, optionally, a front sighting indicator that comprises a brightly colored dot or fiber-optic sighting indicator. The rear sighting indicators may comprise fiber-optic elements that channel light energy towards the user's eye. In use, when the user brings the firearm to a firing position, the user's eyes and mind are able to quickly acquire the light-emitting rear indicators and subconsciously aim the firearm at an intended target, or to point the firearm in a desired direction. Thus, the fast acquiring firearm sighting system enables a firearm to be quickly aimed and fired. The use of the fast acquiring firearm sighting system of the invention reduces the processing load on the user's eyes and brain and makes aiming the firearm intuitive and instant.

22 Claims, 9 Drawing Sheets

FAST ACQUIRING GUN SIGHT

CROSS REFERENCE TO RELATED APPLICATIONS AND INCORPORATION BY REFERENCE

This patent application is a non-provisional of, and claims benefit of priority to, U.S. Provisional Patent Application No. 63/105,131 entitled FAST ACQUIRING GUN SIGHT, filed in the United States Patent and Trademark Office (USPTO) on Oct. 23, 2020, the disclosure of which is incorporated herein by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to systems and methods for gun sights for any gun of any type or nature. More specifically, the field of the invention relates to fast acquiring gun sites that allow pistols, rifles, shotguns and all other firearms to be pointed in a desired direction, or aimed at an intended target, very quickly.

2. Background Art

It is a well-known problem in the art of firearm shooting, as regards all types and styles of firearms including but not limited to pistols, rifles, shotguns and all other types of firearms, that a firearm drawn from a holster or otherwise brought into a firing position may take a period of time to orient with regard to the user's field-of-view and the gun sights that operate to indicate the point of impact of a projectile fired from the firearm. Different types of firearm sighting systems have been conceived and used to aid the user acquire the sight picture. As used herein, "sight picture" includes with its meaning any sighting elements or indicators located on the firearm as well as the intended target, or desired area of impact of a bullet or other projectile fired from the firearm. Some sighting elements consist of a rear sight such as an iron sight that includes a cutout or saddle through which a front site (located on the projectile exit, or muzzle, end of the firearm barrel) may be viewed. In these kind of sights, the front site, which may be for example a post located at the muzzle end of the gun barrel, is aligned with the cutout in the rear sight, enabling the firearm to be aimed at an intended target, or pointed in a desired direction.

However the sighting systems and methods of the prior art have certain shortcomings. In poorly lit, or dark, lighting conditions or in other situations in which it is desired to quickly align the rear and front sites of a firearm so as to aim the firearm at an intended target or area of projectile impact or point the firearm in a desired direction, it may be difficult to align these types of gun sights because they include no features that allow the user's eye and brain to instantly aim the firearm at a specific desired target, or to point the firearm in a desired direction. The gun sights of the prior art require that the user visually focus on the rear sight, the front sight and possibly the target as well, all at the same time. Because all of these points of focus are located at different distances from the user's eye, it takes time for the user to visually cycle through all the different focus points while at the same time orient the firearm in three dimensional space while trying to align the sights with the target. This process can be taxing on the user's mental processing. This type of firearm sighting system, and those like it that use unlighted sighting elements, require processing by the user's brain as the user (i.e. the shooter) attempts to line up the sighting elements on the firearm with the intended target or point of projectile impact. This brain processing, which controls the muscles of the user's hands and arms and thus controls the time in which it takes to line up the sighting elements on the firearm with the intended target or point of projectile impact, may be slowed significantly in situations when the user is under stress such as when confronted by a threat, or such as when environmental conditions, noises, nearby activities, or the like cause the user to become distracted or confused.

In fact, making matters worse in many of prior firearm sight designs, the saddle on the rear sight in the post on the front site are comprised of the same color metal which may be, for example, blued metal or stainless steel. Thus when the user raises a pistol or other firearm to a firing position, the rear sight and the front site may blend together visually, requiring the user to slow down even further to allow their brain to process the sight picture and to visually separate the rear sight in the front site, and attempt to align them such that a proper point of aim is achieved. When the front sight in the rear sight blend together due to the use of similar materials or colors, it may take an inordinate amount of time to align the gun sights.

What is needed in the art, therefore, is an apparatus and/or method adapted to overcome the shortcomings of the prior art by providing a quickly acquired visual sighting system that enables a user to instantly acquire the rear sight saddle arrangement and the front sight in such a manner that the user may quickly aim the firearm toward a desired target or point the firearm in a desired direction. It would especially be desired that the sighting system utilize systems, components, arrangements and materials that enable the user to quickly align the gun sights with the target without conscious thought, thereby reducing aiming or pointing time. The distinction between a second or two of time required to properly aim a firearm may be the difference between life or death in personal defense, tactical or other dangerous situations. Thus, even a slight decrease in aiming time is valuable and enhances the use of the firearm to serve its intended purpose of providing physical protection or tactical advantage over an adversary.

BRIEF SUMMARY OF THE INVENTION

The present invention comprises an apparatus and method that have one or more of the following features and/or steps, which alone or in any combination may comprise patentable subject matter.

The present method and device of the invention overcome the shortcomings of the prior art by providing a sighting system comprising, in embodiments, rear and front sighting elements in which a set of light-emitting or light-reflecting rear sighting indicators, or dots, disposed just outside the sighting saddle on the rear sight such that they command the attention of the user's eye, allowing the firearm to be quickly aimed or pointed. In embodiments the aiming or point may happen so quickly that it occurs without requiring conscious thought. In an embodiment, the invention may also comprise a front sighting indicator, or dot, which may, for example, be disposed on a front sighting post located at the muzzle end of the barrel, that is brightly illuminated such that it commands the attention of the user's eye and brain such that is quickly acquired without requiring conscious thought. The rear sighting indicators may be in the form of colored, photoluminescent, or light-reflecting dots that are deposited or painted in place, or, alternatively, light-emitting or light-reflecting elements, which may be fiber-optic elements, that provide a lighted sighting indication or presentation to the user's eye.

In embodiments, the invention is a fast acquiring firearm sighting system, comprising a pair of light-emitting rear sighting indicators comprising a first sighting indicator and a second sighting indicator, wherein each of said first sighting indicator and second sighting indicator are mounted on the hammer, or handle or trigger, end of a firearm, wherein each of the first rear sighting indicator and the second sighting indicator comprise a light-gathering element, such as, for example, a fiber-optic light-gathering element, that collects and channels light energy toward the eye of a user to assist the user in aiming or pointing the firearm.

In embodiments, when the rear sighting indicators are aligned in relation to a forward sighting indicator located in front of, and laterally between, said pair of rear sighting indicators, the rear sighting indicators and the forward sighting indicator may be used to operate together to indicate a point of aim of the firearm, such as aiming at an intended target, or to indicate a direction of travel of a projectile fired from the firearm.

The first rear sighting indicator and second rear sighting indicator may, in embodiments, be located on the left side and right side, respectively, of an axis of projectile travel wherein the first sighting indicator and the second sighting indicator may be horizontally level, or aligned, with one another when the firearm is disposed in a vertical position in which the rear sighting indicators are located above the barrel of the firearm, and the handle of the firearm is below the barrel and is oriented in a downward direction.

The rear sighting indicator light gathering elements of the invention may comprise, for example, fiber-optic elements. The fiber-optic elements may be shaped, or configured, and located so as to collect and channel ambient, environmental, or any other light toward the eye of a user; or, alternatively, the fiber-optic elements may be configured so as to collect and channel light from a light source, such as a dedicated light source or the light source of an illuminated sighting system such as the light source of a red dot, or reflex, sighting system, toward the eye of a user.

The inventive fast acquiring firearm sighting system may further comprise a forward or front sighting indicator located on, for example, a front sight post located on the muzzle end of the firearm. In embodiments, the forward, or front, sighting indicator may further be defined as comprising a dot of light-reflecting or photoluminescent material located on the front sight and disposed so as to reflect or radiate light energy towards the eye of the user (i.e., generally, rearward toward the handle or hammer end of the firearm). Alternatively, in further embodiments, the forward or front sighting indicator may be defined as a fiber-optic element located on or in a front sight, such as a front sight post, that may be shaped, configured or disposed so as to collect ambient or environment light energy in a light collecting end of the fiber-optic element oriented in a direction to the front of the firearm, and to channel the collected light energy along its length and to emit the collected light energy toward the eye of a user, i.e. rearward toward the handle or hammer end of the firearm. In other embodiments, the invention may comprise a light source in communication with a source of electrical power, where the light source is in optical communication with a light collecting end of the fiber-optic element. In such embodiments, the front sighting indicator fiber-optic element may be disposed so as to collect light energy from the light source in a light-collecting end of the fiber-optic element, channel the collected light energy along its length, and to emit the light energy toward the eye of the user (generally in a rearward direction). In such embodiments, the front sighting indicator light source may be, but is not necessarily, the same light source as used by an illuminated lighting system, if one is present.

In embodiments, the inventive firearm sighting system may comprise an illuminated sighting system such as, for example, a "red dot" or reflex sighting system. In embodiments, the inventive firearm sighting system, including an illuminated sighting system, may be removably attached to a surface of the firearm. In embodiments, the inventive firearm sighting system may comprise a rear sighting assembly that, along with an illuminated lighting system, may be located, or disposed, in a housing. In an embodiment in which the inventive firearm sighting system is intended to be used on a semi-automatic pistol, the housing may be removably attached to the slide or other portion of the pistol. In embodiments, the housing may form a unitary part of the firearm, i.e., the housing of the inventive firearm sighting system may be machined, molded, forged or cast as a unitary part of, or bonded to, welded to or otherwise permanently attached to, a portion of the firearm. In embodiments, such firearm portion may be the slide of a semi-automatic or automatic pistol.

The firearm may be any firearm that projects a projectile, such a gun, compound bow, long bow, cross bow, recurve bow, pistol of any type, rifle, shotgun or any other firearm.

In use, when the user brings a firearm that is equipped with the fast acquiring firearm sighting system of the invention into a firing position such that the firearm is to be aimed at an intended target or pointed in a desired direction, the user's brain and eyes are able to quickly acquire the rear indicators and almost subconsciously move them into position relative to the front sight indicator because these indicators visually stand out against their backgrounds. The inventive fast acquiring firearm sighting system allows sighting to be accomplished by a user automatically, without requiring conscious thought by the user, i.e., subconsciously. Thus, using the fast acquiring firearm sighting system of the invention, a firearm is very quickly accurately trained on an intended target, or pointed in a desired direction. The use of the fast acquiring firearm sighting system of the invention reduces the processing load on the user's eyes and brain and makes aiming or pointing the firearm intuitive and instant, and is thus an improvement on the state of the art.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating exemplary embodiments of the invention and are not to be construed as limiting the invention. In the drawings, like callouts refer to like elements.

In the drawings:

In FIG. 1, optional front sight 002, comprising front sighting indicator 100, is depicted disposed on the muzzle end of the firearm.

Figure 1:
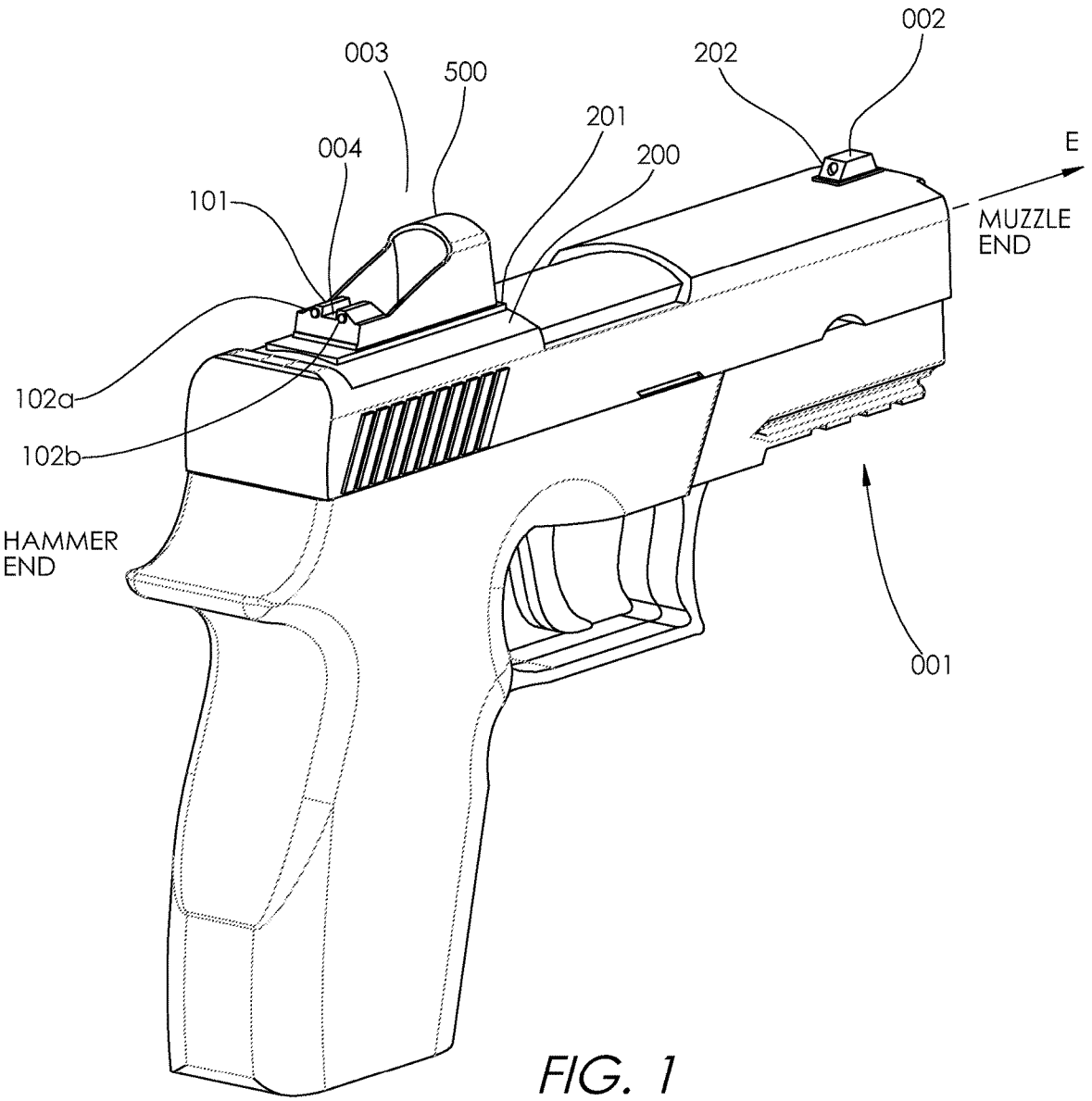
FIG. 1 depicts a perspective view of an exemplary embodiment of the invention used on a typical, non-limiting firearm.

In the non-limiting example depicted in the accompanying drawings, the firearm is depicted as a pistol, however this is only exemplary, as the inventive fast-acquiring firearm sighting system may be used on any conceivable firearm that fires, propels or projects a projectile, such a gun, compound bow, long bow, cross bow, recurve bow, pistol of any type, rifle, shotgun, or any other firearm.

In the figures, like callouts refer to like elements.

DETAILED DESCRIPTION OF THE INVENTION

The following documentation provides a detailed description of the invention.

Although a detailed description as provided in this application contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

The embodiments of the invention may comprise any of the features, elements or steps of the invention described or shown herein or in the drawings, in any combination, and in any order.

As used herein "firearm" includes within its meaning pistols, rifles, shotguns, submachine guns, machine pistols, machine guns, guns of any type, crossbows, revolver or any other form of weapon or device that propels a projectile.

As used herein "illuminated sighting system" includes within its meaning a sighting system for a firearm that may comprise a source of light energy, which may be for example a Light Emitting Diode (LED), laser diode, incandescent light source, photoluminescent material or any structure that provides light energy, including both electrically-powered and electrically-non-powered sources of light energy. In embodiments, the source of light energy is oriented, and may be collimated or focused, such that a beam of light energy G is radiated towards a surface 302 which may be concave shaped and that is at least partially reflective such that a "dot" of reflected light energy is reflected back towards the eye of a user from the at least partially reflective such, and thus the impact point of the light energy on the reflective surface may appear to the user as a dot of light 303 on the at least partially reflective surface in order to aid a user in aiming or pointing a firearm. The light energy reflected by the at least partially reflective surface 302 is reflected rearward towards an eye of the user. Such illuminated sighting systems may be known in the art as "red dot sights" or "reflex" sighting systems. Although "red dot" may be used to refer to some illuminated sighting systems, the reference to the specific color "red", used herein, is for convenience only and is not to be construed as a limitation regarding the color of light energy emitted by the light source of an illuminated sighting system, as such light source may comprise any color of light. The light source of an illuminated sighting system of the invention may emit any color, or any combination of colors, of light energy. In embodiments the light source of the illuminated sighting system of the invention may emit red, green or any other color of light energy. An illuminated lighting system may comprise the source of light energy, the at least partially reflective surface for reflecting light energy emitted from the light source towards the eye of a user, and a housing in which the source of light energy and the at least partially reflective surface are disposed. "Illuminated sighting systems" also includes within its meaning holographic sighting systems, which comprising a series of mirrors and a light source which may be but is not necessarily a laser.

As used herein, "fiber-optic element" includes within its meaning any structure comprising a medium that is capable of transmitting light energy from an entry point of the structure to an exit point of the structure. Fiber-optic elements may comprise any light transmitting material, including but not limited to plastic material and glass material comprising, for example, silica or any other light transmitting material or combination of materials.

As used herein, "muzzle end" of a firearm means the portion of the firearm comprising the end of the firearm from which a projectile exits when a round is fired from the firearm. The muzzle end may also be called the "front" end.

As used herein, "hammer end" of a firearm means the portion of the firearm comprising the end of the barrel that is opposite the muzzle end—in other words, the breech end of the barrel. The hammer end may also be called the "rear" or "handle" end of the firearm. These definitions hold whether or not the firearm actually comprises a hammer.

As used herein, a "slide" of a semiautomatic pistol includes within its meaning a portion of a semiautomatic pistol that is translated rearward when a round is fired from the pistol, operating a pistol mechanism that ejects the empty (fired) shell, and allows or causes a new ammunition round to be loaded into the pistol chamber such that, when the slide returns to its original position, the pistol is ready be fired by the pulling of the pistol trigger. The slide of a semiautomatic pistol is, typically, the upper part that reciprocates, or slides, with recoil during the pistol's operating cycle.

As used herein, "fired" and "propelled" each refer to the act of a firearm propelling a projectile along a direction of travel. In the case of a bullet or projectile fired, or propelled, by a gun such as a pistol, rifle or shotgun, the direction of travel is axis E which is generally coaxial with an axis of the firearm barrel. In such cases the projectile is propelled, or fired, along the direction of travel when gunpowder is rapidly burned in the shell casing, causing the projectile to be propelled, or fired, along the barrel by expanding gases. In the case of a bow in which the projectile is an arrow, the direction of travel may be determined by the travel of the bow string after the bow string is pulled back, creating potential energy in the bow, and then released by the archer, causing the bow to return to a lower energy state, rapidly motivating the string toward the bow, propelling the arrow, in which the string is nocked, along the direction of travel as determined by the motivation of the string. In any event, each type of firearm is characterized by a projectile direction of travel that is determined by the geometry of the firearm and, in some cases, the method propelling the projectile.

As used herein, "light source" and "source of light energy" include within their meanings device that converts electrical energy, or current, to light energy. While any element that converts electrical energy to light energy is included within the meaning of "light source", examples include light emitting diodes, or LEDs, lasers and laser diodes, incandescent light sources and all other types of light sources. When "light source" is used herein, it is understood that the light source may be in electrical communication with a source of electrical power, such as a battery or other electrical energy source, of sufficient electrical current capacity to power the light source, such that it emits light energy. Typically sources of light energy may be characterized as having a direction, or radiation pattern, of radiation of the emitted light energy.

As used herein, "projectile" includes within its meaning any structure propelled or fired by a firearm. In the case in which the firearm is a gun, such as for example a pistol, "projectile" includes within its meaning "bullet" or "shot" such as used in a shotgun shell. In the case in which the firearm is a bow or crossbow, for example, "projectile" includes within its meaning "arrow" or "bolt".

The invention may be comprised of the various features and elements described herein and shown in the accompanying figures, in any combination, orientation or configuration. The drawings shown are for exemplary embodiments. It is understood that the scope of the claims includes not only the described and depicted exemplary embodiments but all legal equivalents thereof.

It is an object of the invention to provide a fast-acquiring gunsight that allows a user's brain and eyes to quickly acquire a firearm's rear sighting indicators, enabling a user to subconsciously move them into position relative to the front sight indicator, so that a firearm that comprises the fast-acquiring gunsight is able to be very quickly and accurately trained on an intended target, or pointed in a desired direction.

It is a further object of embodiments of the invention to provide a fast-acquiring gunsight that may be attached, either removably or permanently, to a surface of a firearm, such as in an aftermarket application in which the fast-acquiring gunsight is assembled onto the firearm after the firearm ships from the manufacturer.

It is a further object of embodiments of the invention to provide a fast-acquiring gunsight that is either manufactured and assembled into a structure of a firearm such that the firearm ships from the factory or third party manufacturer in a manner in which the fast-acquiring gunsight is permanently attached to, or forms a unitary part of, the firearm.

It is a further object of embodiments of the invention to provide a fast-acquiring gunsight that utilizes light gathering elements, such as fiber-optic elements, to provide sighting indicators to a user. Such light-gathering elements may collect light and channel the collected light towards the eye of the user, forming sighting indicators that enable the firearm to be quickly aimed or pointed.

Figure 2:
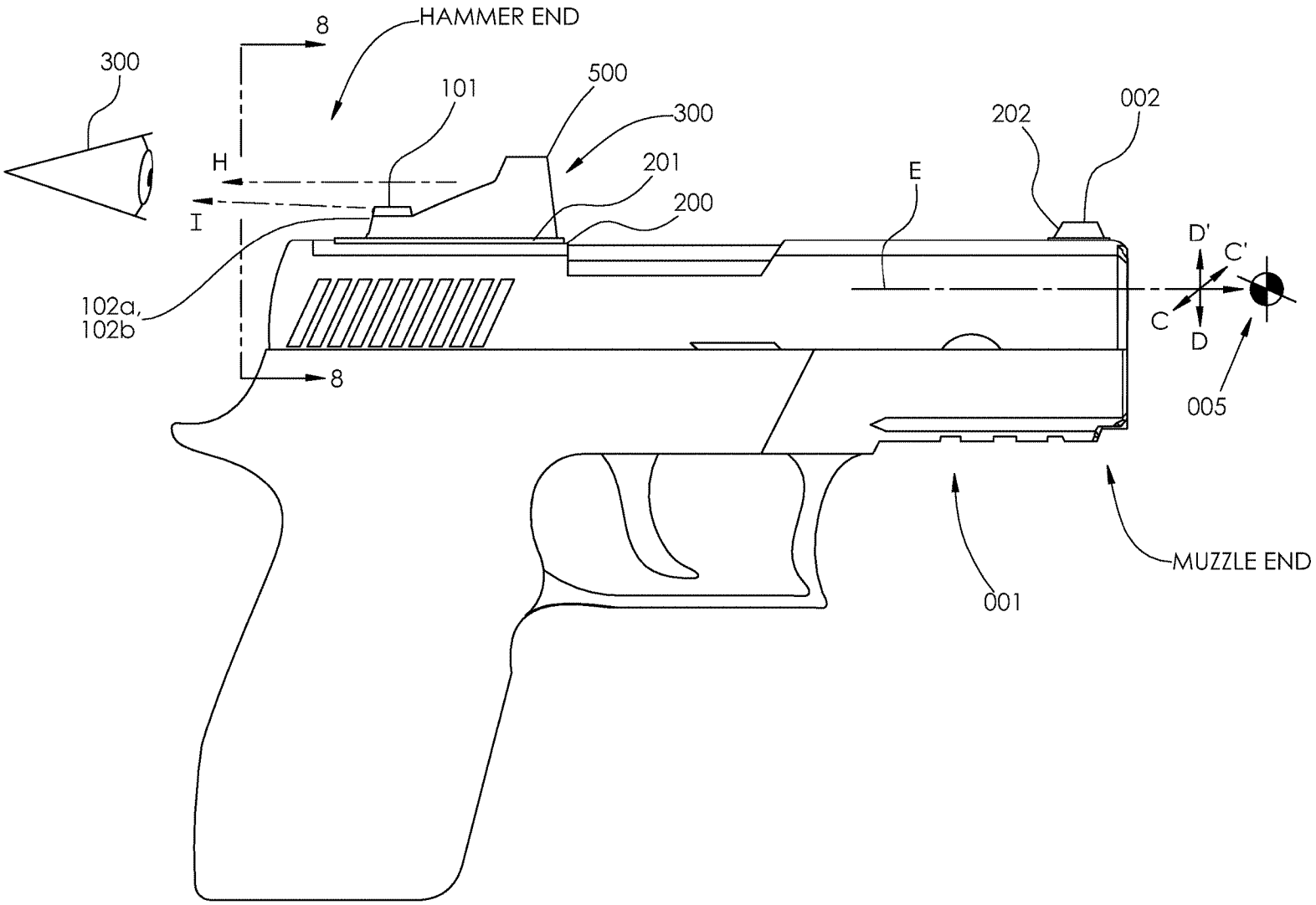
FIG. 2 depicts a side view of an exemplary embodiment of the invention used on an exemplary firearm.

Referring now to FIGS. 1 and 2, the sighting system of the invention comprises, in embodiments, a first rear sighting indicator 102*a* and a second rear sighting indicator 102*b* that may, in embodiments, each be disposed outboard of an edge of an optional sighting notch, or saddle, 004, in the rear sight of a firearm 001 that may be, in embodiments, disposed on or near the hammer, or rear, end of firearm 001. In embodiments the rear sighting indicators 102*a* and 102*b* may comprise optical fibers 105 that collect and direct light through along their length, further directing the collected light rearward I towards the eye of a user 300. Rear sighting indicators 102*a* and 102*b* may be positioned such that, when oriented with respect to a front sighting indicator 202, a reflected dot 303 (which may be colored, e.g. a red, green or other color dot) in reflective surface 302, or any other visual aid as viewed from the rear of the firearm, a user of firearm 001 is able to quickly aim firearm 001 at a target 005, or point firearm 001 in a desired direction such that a projectile exiting the firearm barrel muzzle end will impact the desired target 005 or travel in the desired direction that is coaxial with muzzle axis E. Front sighting indicator 202 may be, for example, provided by a brightly colored dot of paint or other material, or it may be provided by a rearward-facing light transmitting end of an optical fiber 100 (see FIG. 6) disposed in a front sighting post 002 that may be located on the muzzle end of the barrel of a firearm 001. In embodiments, optical fiber 100 may alternatively collect light energy from a light source such as an LED, laser or other light source that is disposed so as to illuminate the light-collecting forward-facing end of optical fiber 100 enabling the light-collecting forward-facing end of optical fiber 100 to collect light energy from the light energy source and channel it along its length to its rearward-facing ends, where the light emanates from the rearward-facing end of optical fiber 100 towards the eye of a user 300, forming the front sighting indicator 202.

Still referring to FIGS. 1 and 2, rear sighting assembly 003 may comprise rear sight housing 500, which may be disposed on any upper surface 200 of a structure a of firearm 001. In embodiments in which the firearm is a semiautomatic pistol, rear sight housing 500 may be disposed on an upper surface 200 of firearm 001. In embodiments, rear sight housing 500 may be removably attached to an upper surface 200 of a structure of a pistol, which may be an upper surface of a slide of a semiautomatic pistol. The removable attachment may be by any means known in the art such as, for example, threaded fasteners, dovetail or other slide engagement in which a slide portion having a cross sectional shape, such as a dovetail shape is attached to or forms a part of the surface of housing 500 that is in contact with the upper surface 200 of a structure of firearm 001, and a complementary cross sectional shape is attached to or forms a part of upper surface 200 of a structure of firearm 001, so that the complementary cross sections form a sliding engagement between housing 500 and an upper surface 200 of firearm 001, or any other means of removable attachment. Alternatively, rear sight housing 500 may be securely attached to an upper surface 200 of a structure of a pistol, which, in embodiments, may be an upper surface of a slide of a semiautomatic pistol, by any non-removable means of attachment known in the art such as, for example, chemical bonding, welding, brazing, press fit or any other non-removable means. In embodiments in which the fast acquiring gun sight system of the invention is removably attached to an upper surface 200 of a structure of a firearm, red dot or reflex gunsights comprising an embodiment of the fast acquiring gun sight may be produced for aftermarket installation on a firearm. Alternatively, in embodiments, rear sight housing 500 and the elements of the fast acquiring gun sight of the invention may form an integral part of a structure of firearm 001, such as, for example, the slide of a semiautomatic pistol; i.e., such elements may be cast, machined, forged or otherwise form an integral (i.e., unitary) part of the structure of the firearm. In this embodiment, a firearm may ship from the factory with the rear sighting assembly 003 included as integral part of the original firearm product offering to a buyer. Alternatively, in embodiments, the fast acquiring gun sight system of the invention, or any portion of it, may be separately fabricated and assembled, and may be permanently attached to a structure, such as an upper surface, of firearm 001 as described elsewhere herein such that the gun is shipped from the factory or third party manufacturer having the fast acquiring gun sight system of the invention 003 affixed to the firearm, ready for use.

Still referring to FIGS. 1 and 2, a projectile fired from firearm 001 may travel along axis E, which may be coaxial with an axis of the barrel of the firearm, the projectile exiting the muzzle end of firearm 001 as it travels towards an intended target 005 or along a desired direction of travel that is colinear with axis E. The desired direction of projectile travel may be determined by the user's pointing or aiming of the firearm. It is an object of the invention that the fast acquiring gun sight of the invention enables a user to easily, even subconsciously, aim the firearm at an intended target, or point the firearm barrel axis E, in a desired direction more quickly, and with less mental effort, as firearm sighting systems of the prior art. The muzzle and hammer ends of firearm 001 are shown for reference.

Figure 3:
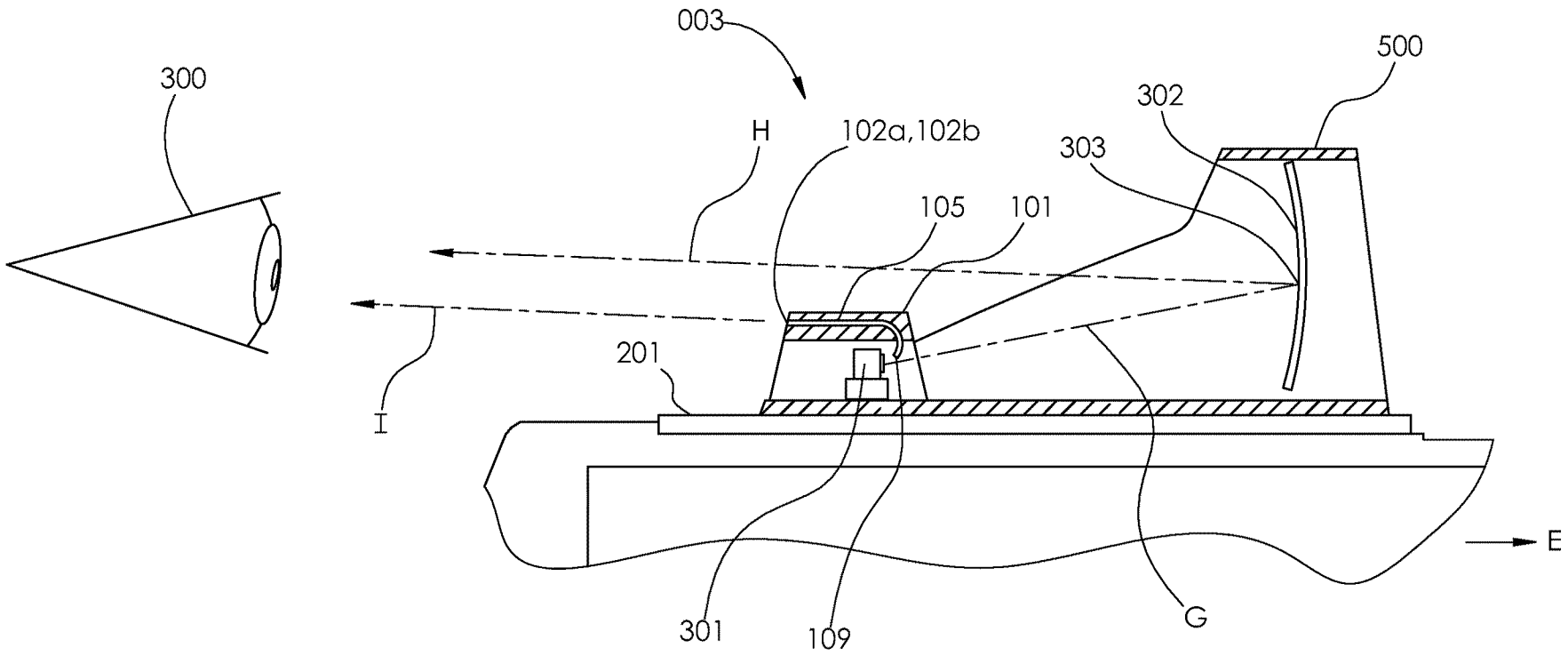
FIG. 3 depicts an expanded view of an embodiment of the invention in which the rear sighting elements are fiber-optic elements that are disposed, located, shaped and configured so as to collect and channel light from a light source of an illuminated sighting system, such as from the light source of a "red dot" or reflex sighting system, toward an eye of a user.
Figure 4:
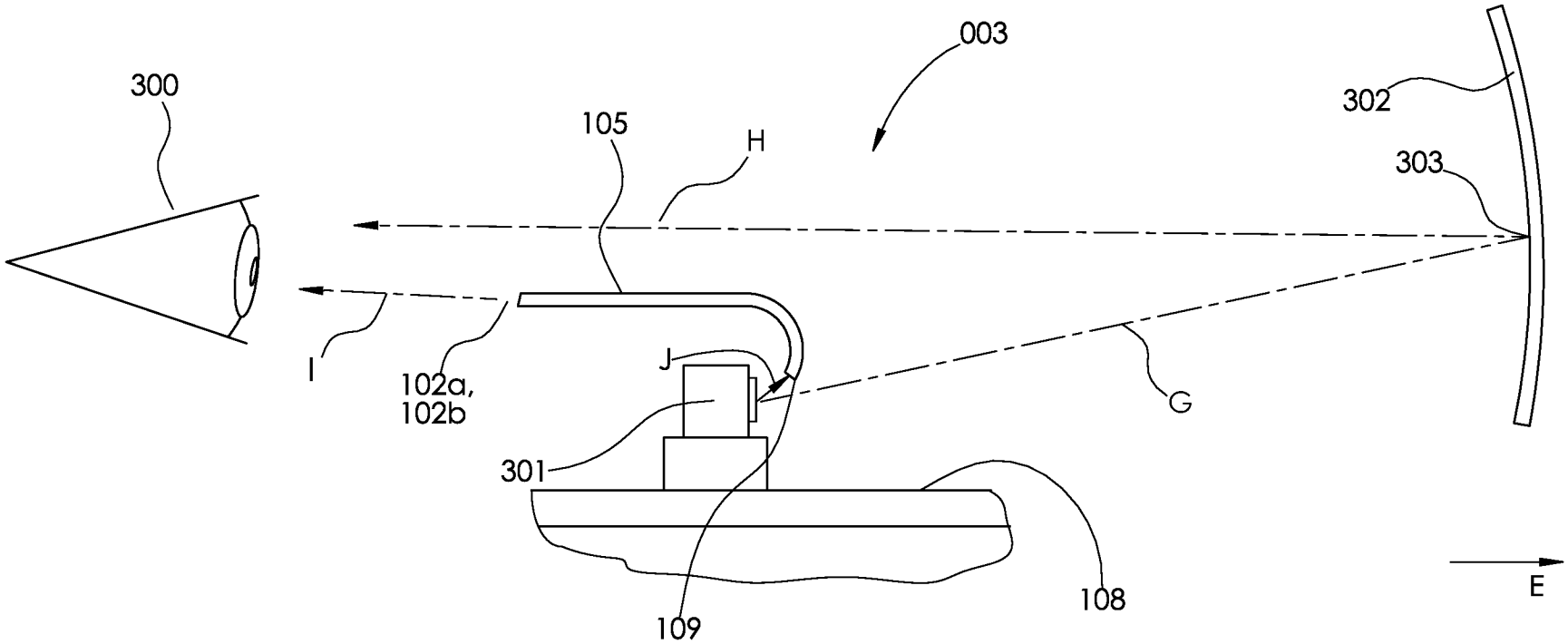
FIG. 4 depicts an expanded view of an embodiment of the invention in which the rear sighting elements are fiber-optic elements that are disposed and configured so as to collect and channel light from a light source of an illuminated sighting system, such as a "red dot" or reflex sighting system, toward an eye of a user.

Referring now to FIGS. 3 and 4, an expanded view of an embodiment of the invention in which the rear sighting indicators 102*a* and 102*b* are the rearward-facing ends of fiber-optic elements 105 that may disposed and configured in a structure 101, which may but does not necessarily form part of housing 500, so as to collect light energy J from a light source 301 of an illuminated sighting system, such as from the source of light energy 301 of a red dot or reflex sighting system, and to channel the collected light energy toward an eye of a user 300 along path I in order to assist the user in quickly aiming the firearm at a desired target 005, or pointing the firearm in in intended direction that is coaxial with the axis E of the firearm barrel. In an embodiment, fiber-optic elements 105 collect light energy J at their light collecting ends 109, the collected light energy J being emitted from the source of light energy 301, and directs the collected light energy along their length such that it exits rearward by way of rear sight indicators 102*a* and 102*b*, which may be the rearward facing ends of fiber-optic elements 105, such that the light emitted from rear sight indicators 102*a* and 102*b* is directed along a path I towards the eye of a user 300, producing visually capturing, illuminated rear sighting indicators 102*a* and 102*b*. The fiber-optic elements 105 that direct light into and through the rear sight indicators 102*a* and 102*b* towards the eye of a user 300 along path I are an improvement over the state of the art of simple painted dots that have been historically used as rear sighting indicators, because they are brighter and easier for the eyes and brain of a user to acquire quickly, even subconsciously. The light I emanated from the rearward facing ends of fiber-optic elements 105 create lighted dots 102*a* and 102*b* that are visually capturing to the eye and mind of the user. The lighted dots created by the fiber-optic elements 105 at rear sight indicators 102*a* and 102*b* enable a user to intuitively, i.e., without conscious thought, bring a firearm 001 into quick alignment between the rear sighting indicators 102*a* and 102*b* and the front sighting indicator 202, red dot at 303 or other visual sighing aid, without requiring conscious thought by the user. The quickness with which the firearm sighting task is completed using the invention is a useful improvement over the firearm sighting systems of the prior art, and is, in embodiments, enabled by the use of the fiber-optic elements 105 to collect and transmit light energy from light source 301, creating lighted rear sight indicators 102*a* and 102*b*, as described herein.

Still referring to FIGS. 3 and 4, in embodiments, the rear sighting assembly 003 may comprise fiber optic elements 105 forming first and second rear sighting indicators 102*a* and 102*b* and an illuminated sighting system comprising a light source 301 and reflective surface 302, all of which may be located in a housing 500. Housing 500 may further comprise an electrical battery in electrical communication with light source 301 for providing electrical power to light source 301 such that it emits light energy G towards at least partially optically reflective surface 302 and it emits light energy J towards the optically receiving end of optical fibers 105. Thus, the rear sighing assembly 003 may be packaged into housing 500 forming a complete, operable, packaged rear sighting assembly that may be marketed as a stand-along rear sighting assembly that can be attached to a firearm at the firearm factory, or may be attached by a end user, dealer, gunsmith or other person as an aftermarket addition for enhancing a firearm.

Still referring to FIGS. 3 and 4, in embodiments, the fast acquiring sighting system of the invention may collect light energy from a light source or sources that are located in the sighting system itself, and may channel the collected light energy towards the eye of a user in order to aid the user in pointing or aiming the firearm'. In such embodiments, optical fiber elements 105 may be disposed, shaped or configured as is necessary to collect at least a portion of the light energy J emitted by a light source such as, for example, light source 301 in their light collecting ends 109. Such disposition and configuration may take any location, orientation, or shape so as to enable the light collecting ends 109 of optical fiber elements 105 to collect at least a portion of the light energy J emitted by light source 301. In embodiments, fiber optic elements 105 may be shaped, bent, channeled, configured or otherwise formed in order to present a light-collecting, energy-incident end 109 to light source 301, such that at least some of the light energy J emanating from light source 301 generally in the direction of arrow G is incident upon the light collecting ends 109 of optical fiber elements 105. This impinging light energy from light source 301 is collected by the light collecting ends 109 of optical fiber elements 105 and is directed, channeled, transmitted or propagated along the length of optical fiber elements 105, ultimately exiting optical fiber elements 105 from the light-exiting end of the optical fiber elements 105 forming rear sight indicators 102*a* and 102*b*, the light exiting the light-exiting end of the optical fiber elements 105 towards the eye or eyes of a user 300 along path I. From the user's point of view, the light exiting the light-exiting ends of the optical fiber elements 105 towards the eye or eyes of a user 300 forms lighted rear sighting elements ends 102*a* and 102*b* that are operable to enable a user to quickly aim or point firearm 001 as described herein. In this manner, in this embodiment, the fast acquiring sighting system and method of the invention may use light collected from a light source such as light source 301 to form lighted rear sighting indicators 102*a* and 102*b*. Surface 108 may be an interior surface of housing 500. Also shown for reference are at least partially reflective surface 302, "red dot" light reflection point 303, and "red dot" reflected light path H).

Figure 5:
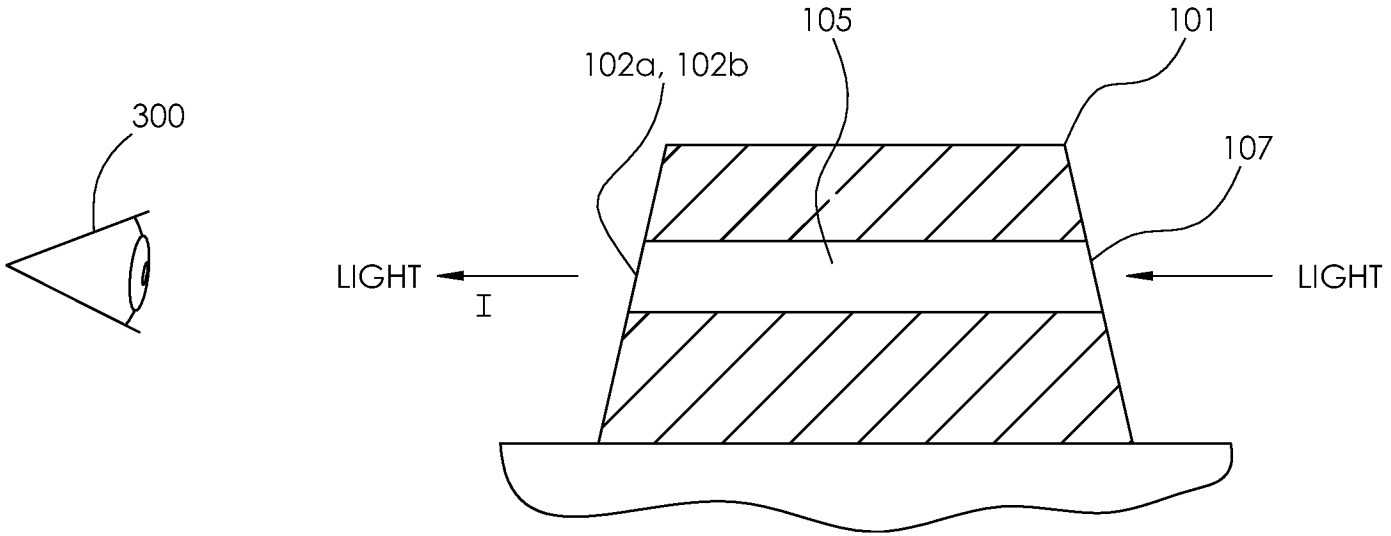
FIG. 5 depicts a cross-section view of an embodiment of the rear sighting indicators of the invention in which fiber-optic elements are used to collect light energy in a light collecting end, and to channel the collected light energy from the light-collecting end towards the back, or hammer, end of the firearm, where the light energy exits the optical fiber elements 105 light-emitting ends emit the collected and channeled light energy towards the user's eye, effectively creating lighted rear sighting indicators in the form of light-emitting dots 102*a* and 102*b* by light emitted from the rearward facing, that is to say, user-facing, ends of the fiber-optic elements 105, the emitted light exiting the light-emitting ends of fiber-optic elements 105 along a direction H towards the eye of a user 300.

Referring now to FIG. 5, a cross section view of an embodiment of the rear sight indicators 102*a* and 102*b* of the invention is shown in which fiber optic elements 105 captured in structure 101, which may, in embodiments, form a portion of housing 500, collect light from their forward facing, or muzzle-end facing, ends 107 and channels the collected light energy along their length to their rearward facing end, where the collected and channeled light energy exits the rearward facing end of fiber optic elements 105 along path I towards the eye of a user 300, forming lighted rear sighting elements ends 102*a* and 102*b* that are operable to enable a user to quickly aim or point firearm 001 as described herein.

Figure 6:
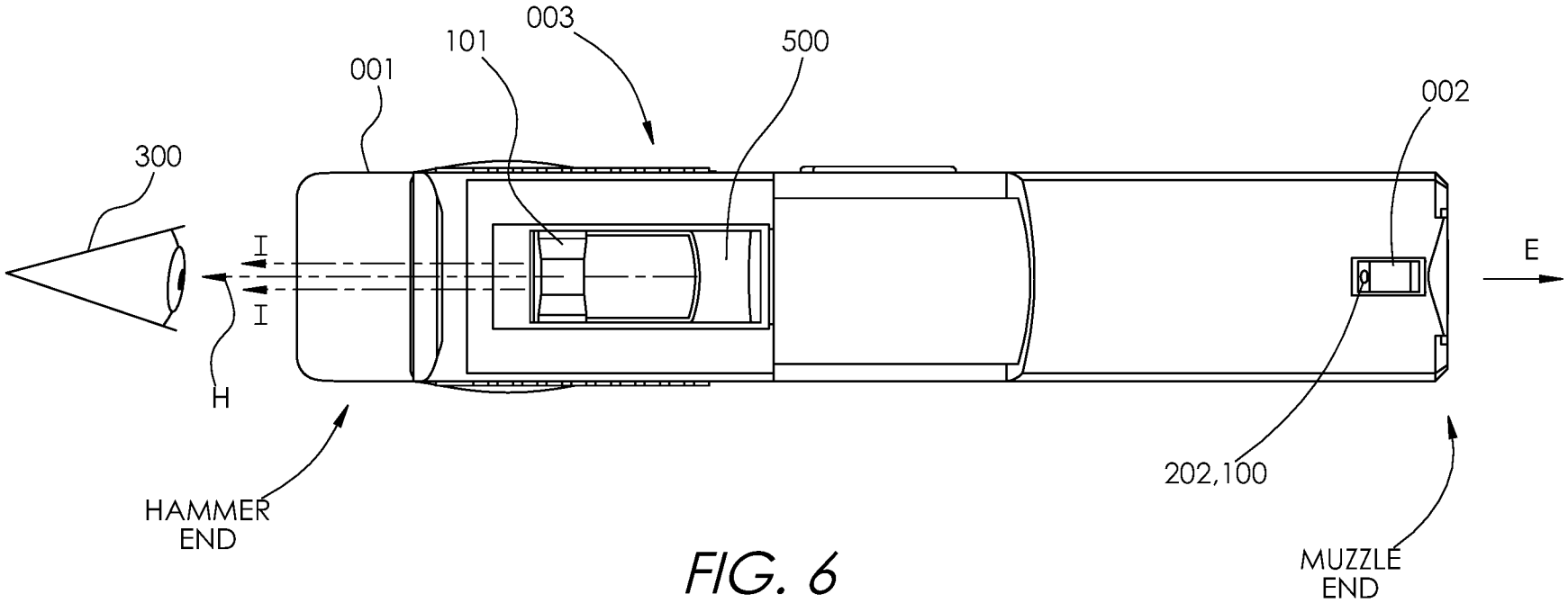
FIG. 6 depicts a top view of a firearm having an exemplary embodiment of the inventive fast-acquiring firearm sighting system installed thereon, either through aftermarket installation or by manufacturing the inventive firearm sighting system into a portion of the firearm, for example, in the slide of a semi-automatic pistol. In this non-limiting example, the firearm is depicted as a pistol, although the firearm may be any type of firearm.
Figure 7:
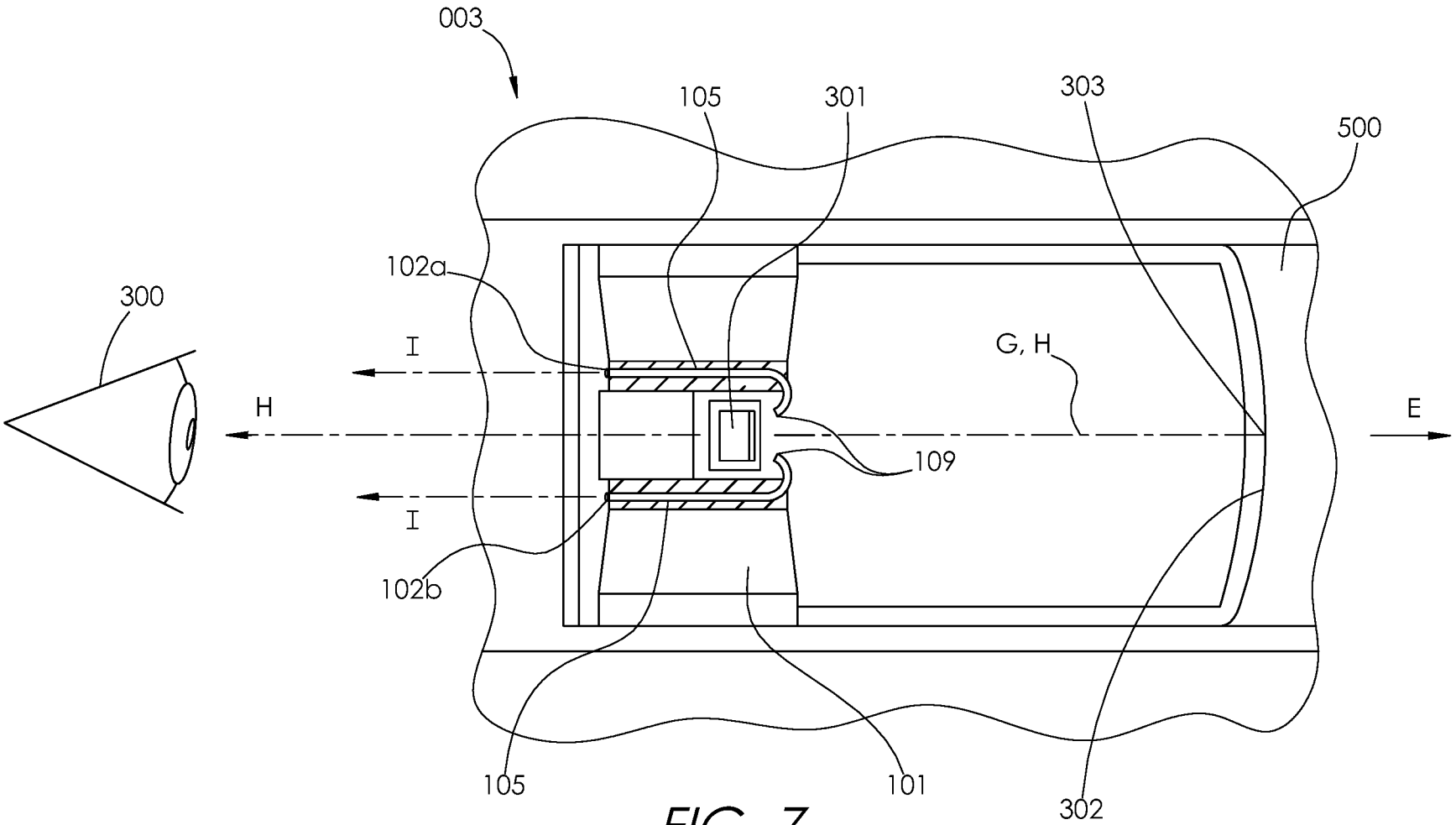
FIG. 7 depicts an expanded top view of an embodiment of the inventive firearm sighting system, depicted schematically, to show the relative location of components and operation of the invention an exemplary, non-limiting embodiment.

Referring now to FIGS. 6 and 7, a top view of firearm 001 having an exemplary embodiment of the inventive firearm sighting system installed thereon, either through aftermarket installation or by manufacturing the inventive firearm sighting system into a portion of the firearm, for example, in the slide of a semi-automatic pistol, is depicted. Rear sighting assembly 003 may be attached to, or may form a part of, the hammer end of firearm 001. In this non-limiting example, firearm 001 is a pistol, although the firearm may be any type of firearm. Light energy emanating from light source 301 is collected by optical fibers 105, which then channel the collected light energy along their length where it emanates from the reward facing ends of optical fibers 105, forming from and second rear sighting indicators 102*a* and 102*b*, the light energy being directed along paths I towards the eyes of a user 300. Reflective surface 302, optional front sight post 002, front sighting indicator 202, optical fiber 100, structure 101, "red dot" light reflection point 303, housing 500 and reflected reflex or red dot light energy H are shown for reference.

Figure 8:
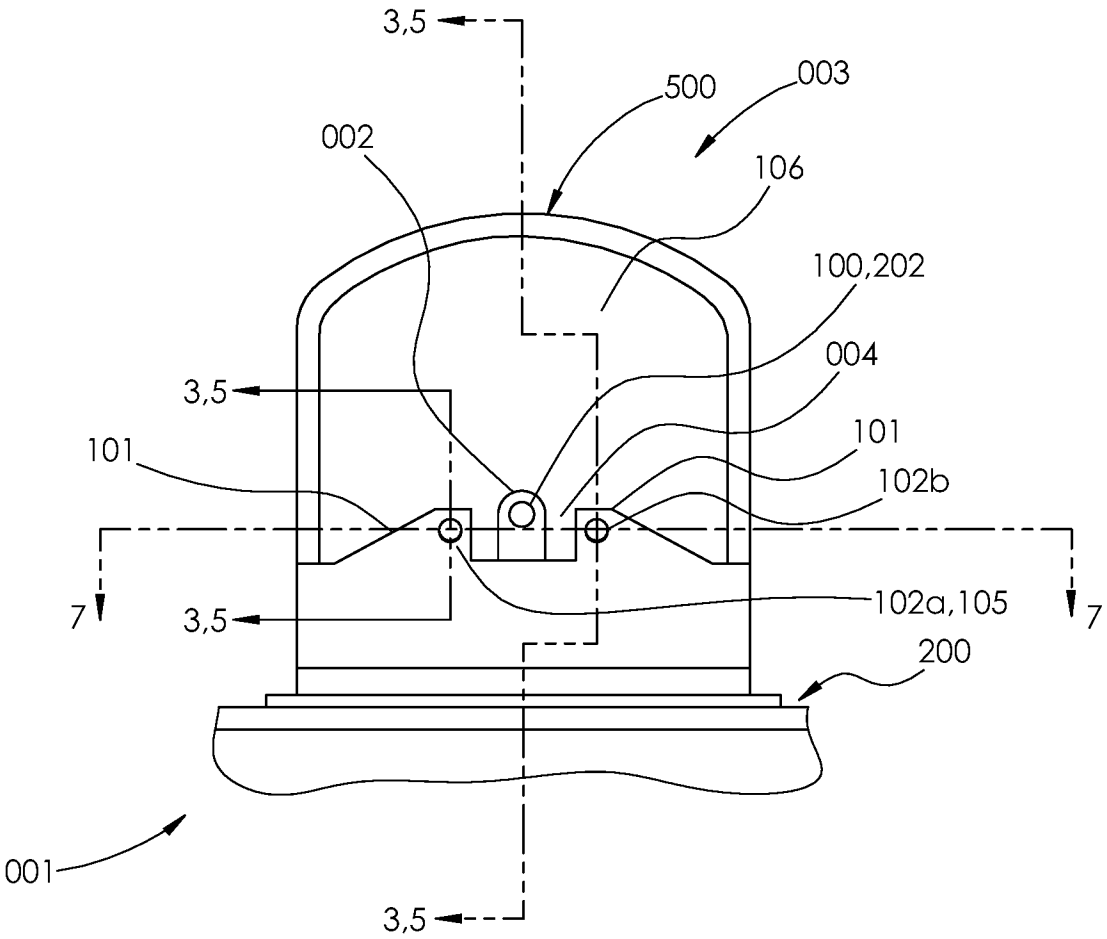
FIG. 8 depicts a rear view of an embodiment of the inventive firearm sighting system, looking from the rear, handle, or hammer end of the firearm towards the muzzle of the firearm, and thus depicts an exemplary view of the sighting picture as may be seen by a user when using the inventive firearm sighting system.

Referring now to FIGS. 6 and 8, in an embodiment, the fast acquiring gun sight of the invention may also comprise front sighting indicator 202, that is created by a painted dot, an LED, laser or other source of light energy, or an optical fiber 100 captured in front sighting post 002 that collects light energy from the muzzle end of firearm 001 or may be illuminated by a source of light energy such as an LED, laser or other source of light energy. In the embodiments in which the front sighting indicator 202 comprises an optical fiber 100, the optical fiber 100 channels the collected light energy along its length where the collected light energy emanates from the rearward facing end of optical fiber 100 and is radiated along a path rearward towards the eye of a user 300.

Figure 9:
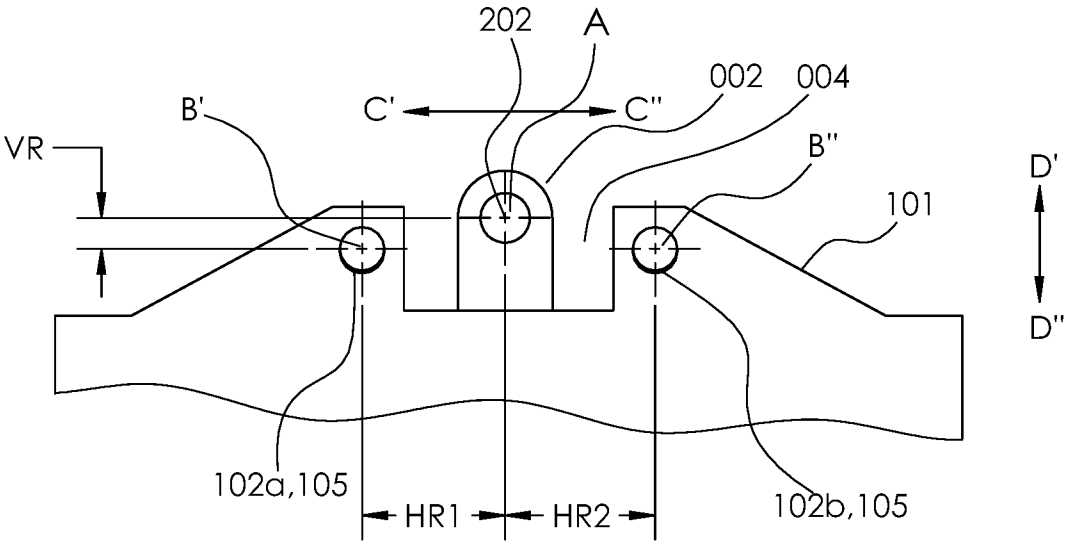
FIG. 9 depicts a rear view of an exemplary embodiment of the inventive firearm sighting system, looking from the rear, handle, or hammer end of the firearm towards the muzzle of the firearm, and thus depicts an exemplary view of the sighting picture as may be seen by a user when using the inventive firearm sighting system, in which the view is expanded and simplified to show the sighting elements.

Referring now to FIGS. 8 and 9, rear views of an exemplary embodiment of the inventive firearm sighting system, looking from the rear, handle, or hammer end of the firearm towards the muzzle of the firearm, is depicted. Rear sighting assembly 003 may be attached to a surface of, or form a part of, firearm 001. In FIGS. 8 and 9 an example of proper alignment of the rear sighting indicators 102*a* and 102*b* with optional front sighting indicator 202 is depicted. In embodiments, optional sighting notch 104 may be present to assist the user by providing additional visual reference to aid in aligning the rear sighting indicators 102*a* and 102*b* and front sighting indicator 202 for aiming or pointing the firearm. Front sighting indicator 202 may comprise a painted light-reflective or photoluminescent dot, or, in embodiments, an optical fiber 100 that channels light energy collected from the muzzle end of the gun rearward towards the eye of a user 300. Rear sight housing 500 is depicted for reference. Optical fibers 105 channel light energy along their length to become rear sighting indicators 102*a* and 102*b*. In the embodiment depicted, rear sighting indicators 102*a* and 102*b* are the rearward facing ends of optical fibers 105, which emit the channeled light energy rearward towards the eye of a user 300 along lines of emission I as shown in FIGS. 2, 3, 4 and 5.

Still referring to FIGS. 8 and 9, in operation, a user of firearm 001 may find themselves in a situation in which they need to quickly aim or point the firearm. As an example, a user may be carrying the firearm on their person by means of a holster, a pocket in clothing, or other firearm carrying means. If the user should need to quickly aim or point the weapon, such in the case in which the user is suddenly in a dangerous situation, they can retrieve the firearm from its carrying position and bring it up to be at eye level between the user and the intended target 005 or intended direction of aim. As firearm 001 comes into view in the user's visual field, the sighting indicators of the invention may be subconsciously registered by the user's eyes and brain because they stand out from the visual background due at least to the fact that rear sighting indicators 102*a* and 102*b* are emitting light towards the eyes of the user. While this is occurring in the user's brain, the user continues to bring the firearm into a position in which the firearm is generally pointed in the intended direction. As this occurs, the user's brain, aided in ascertaining the rear sighting indicators due to the light energy emitted by them towards the eyes of the user, is able to subconsciously direct the final aiming or pointing of the firearm, adjusting the vertical point of aim by adjusting the distance VR between rear sighting indicators 102*a* (point B') and 102*b* (point B") and optional front sighting indicator 202 along D'-D" to achieve a desired vertical point of aim, and by adjusting the horizontal point of aim by adjusting HR1 and HR2 horizontally along C'-C" to achieve a desired horizontal relationship between optional front sighting indicator 202 (or, alternatively, reflected dot 303 as described below), rear sighting indicator 102*a* and rear sighting indicator 102*b* achieve a desired horizontal point of aim. When the sighting indicators 102*a*, 102*b* and 202 (or, alternatively, reflected visible dot 303 as described below) are in a predefined desired spatial relationship (i.e. when VR, HR1 and HR2 are set at predefined distances so as to achieve an intended aiming or pointing of firearm 001), the intended point of aim or direction of aim is achieved, and firearm 001 is now in a state in which it may be fired at an intended target, or in an intended direction. This predefined desired spatial relationship between sighting indicators 102*a*, 102*b* and 202 (or, alternatively, reflected visible dot 303 as described below) is achievable in a very short period of time because the light-emitting nature of the rear sighting indicators enables the user's brain to subconsciously observe the spatial relationship between sighting indicators 102*a*, 102*b* and 202 to direct the hands and arms of a user such that they achieve the desired spatial relationship between sighting indicators 102*a*, 102*b* and 202 (or, alternatively, reflected visible dot 303 as described below), causing the firearm to be pointed or aimed as desired, and relieving the user of having to intentionally think their way through each step of aiming or pointing their firearm at an intended target or intended direction. This subconscious processing by the user's brain occurs much more quickly than is possible with systems of the prior art, which require more cognitive processing steps in order to assist a user in aiming or pointing their firearm at an intended target or in an intended direction. With repetitive training of drawing the firearm, aiming at an intended target, optionally firing the firearm, and returning the firearm to its at-rest position, the subconscious ability of the user to point or aim the firearm in the intended directly can be trained such that proper aim can be achieved using the system and method of the invention automatically and accurately, even in environments and sight picture backgrounds having multiple ongoing distractions.

As an alternative to using front sighting indicator 202 in the foregoing firearm aiming and pointing method, in embodiments, the reflected "red dot" visible dot 303 on at least partially reflective surface 302 (see FIGS. 3 and 4) may be used in place of front sighting indicator 202 to aim and point the firearm as described above. In such embodiments, the firearm may be quickly aimed using the system and method of the invention, with all the advantages of the invention, without the need for any front sighting post 002 to be present because reflected "red dot" point 303 takes the place of front sighting indicator 202. I.e., in such embodiments, the front sighting indicator is reflected visible dot 303. Further, such embodiments may be used to provide a quick acquiring firearm sighting system comprising completely contained in housing 500. In such embodiments, the firearm sighting system of the invention may be completely disposed, or contained, in housing 500. In this embodiment the firearm sighting system may comprise housing 500, first and second rear sighting indicators 102*a* and 102*b*, and, referring to FIGS. 3 and 4, an illuminated sighting system comprising a light source 301 in communication with a source of electrical power, such as a battery. The light source 301 may emanate, or emit, a beam of light energy G towards an at least partially reflective surface 302, wherein the at least partially reflective surface 302 reflects at least a portion of a beam of said beam of light energy H towards an eye of a user 300, forming a visible dot 303 on the at least partially reflective surface 302 at point 303. The first rear sighting indicator 102*a* and the second rear sighting indicator 102*b* may comprise a light-gathering element 105, such as a fiber optic element, that collects light energy in a light-collecting end and channels the collected light energy toward an eye of a user 300 when the user is attempting to aim firearm 001. The light source 301, the reflective surface 302 and the first rear sighting indicator 102*a* and said second sighting indicator 102*b* may be disposed and contained within housing 500. When first rear sighting indicator 102*a* and said second sighting indicator 102*b* are positioned relative to visible dot of light energy 303 on the at least partially reflective surface 302 in a predefined desired spatial relationship (i.e. when VR, HR1 and HR2 are set at predefined distances so as to achieve an intended aiming or pointing of firearm 001), they are operable to indicate a direction of travel of a projectile fired by the firearm, or to indicate an expected point of impact of a projectile fired by the firearm. The advantage of this embodiment is that the firearm sighting system may be completely packaged and contained within housing 500, including the rear sighting indicators 102*a* and 102*b*, and the front sighting indicator 303. Thus the invention may be produced as a complete firearm sighting product that is contained within housing 500 that can be sold as an accessory and added to a firearm on an aftermarket basis by simply attaching housing 500 to a surface of firearm 001. Alternatively, this embodiment of the invention may be manufactured with the firearm by manufacturing housing 500 as unitary part of the firearm structure, or by permanently or removably attaching housing 500 to a portion of the firearm structure at the time of manufacture of the firearm. In this embodiment, front sighting post 002 and front sighting indicator 202 are not needed.

In any embodiment, when sighting indicators 102*a*, 102*b* and 202 (or, alternatively, reflected visible dot 303) are in a predefined desired spatial relationship, the rear sighting indicators and front sighting indicator are, when used together, operable to indicate a direction of travel of a projectile fired by the firearm 001, or to indicate an expected point of impact of a projectile fired by the firearm. The predefined desired spatial relationship between the rear sighting indicators and front sighting indicator may vary, e.g., be different, for different models, makes, types or firearm manufacturers due to the difference in certain dimensions of the firearm structure between manufacturers or models, etc. For any specific firearm model, type or manufacturer, a specific predefined desired spatial relationship between the rear sighting indicators and front sighting indicator may be determined by using bore sighting techniques, or by firing the firearm at a target, and recording the spatial relationship between the rear sighting indicators and front sighting indicators when the boresight is aligned with the desired target or fired projectiles are impacting the desired target. In this manner a specific predefined desired spatial relationship between the rear sighting indicators and front sighting indicator, as depicted in FIGS. 8 and 9, may be determined for any firearm.

In an embodiment, the rear sighting indicators 102*a* and 102*b*, and optionally, sighting saddle 004, may comprise a part of an optical sighting system 003 that may be an aftermarket attachment for a firearm, such as a pistol. Optical sighting system 003 may include an optical element, such as for example, a lens 106 that provides improved visibility through proper tinting or coloring, or may provide some level of magnification in order to assist the user in viewing a target when sighting the firearm.

In embodiments, the rear sighting elements 102*a* and 102*b* of the invention may be added to a firearm on an aftermarket basis in the form of an aftermarket apparatus that is mounted on or near the hammer end of the firearm 001. In other embodiments, the rear sighting elements of the invention and/or the front sighting element of the invention may comprise a portion of a firearm as it is originally manufactured.

The embodiments of the invention depicted in the figures are exemplary in nature and are not intended to be limiting to the form, structure or arrangement of the elements of the invention. Included within the intended scope of the claims are all elements of legal equivalence.

Any of the described features and elements of the invention may be present in in embodiment, in any combination, in any number, and in any relationship.

What is claimed is:

1. A firearm sighting system, comprising:

a pair of rear sighting indicators comprising a first sighting indicator and a second sighting indicator;

wherein each of said first rear sighting indicator and said second rear sighting indicator each comprise a light-collecting element that collects and channels light energy toward an eye of a user when said user is attempting to aim said firearm;

wherein, when said first rear sighting indicator and said second rear sighting indicator are aligned with a front sighting indicator in a predefined spatial relationship, said rear sighting indicators and said front sighting indicator are operable to indicate a direction of travel of a projectile fired by the firearm, or to indicate an expected point of impact of a projectile fired by the firearm;

wherein said front sighting indicator is further defined as a visible dot created by the reflection of light from a light source of an illuminated lighting system from an at least partially reflective surface that reflects light energy from the light source toward the eye of a user.

2. The firearm sighting system of claim 1, where said first rear sighting indicator and said second rear sighting indicator are located on the left side and right side of an axis of said projectile direction of travel, respectively.

3. The firearm sighting system of claim 1, wherein said light collecting elements are fiber-optic.

4. The firearm sighting system of claim 3, wherein said fiber-optic elements are configured so as to collect ambient light in a light-collecting end.

5. The firearm sighting system of claim 3, wherein said fiber-optic elements are configured so as to collect light energy from a light source in a light-collecting end.

6. The firearm sighting system of claim 5, wherein said light source is further defined as a light source of an illuminated sighting system.

7. The firearm sighting system of claim 6, wherein said light source of an illuminated lighting system is further defined as being selected from the group consisting of a light emitting diode and a laser.

8. The firearm sighting system of claim 6, wherein said first and second rear sighting indicators and said illuminated sighting system are disposed in a housing, and wherein said housing is adapted to be removably attached to a surface of a firearm.

9. The firearm sighting system of claim 1, wherein said light source is further defined as being selected from the group consisting of a light emitting diode and a laser.

10. The firearm sighting system of claim 1, wherein said front sighting indicator is further defined as a front sight post located on the muzzle end of said firearm.

11. The firearm sighting system of claim 10, wherein said front sight post further comprises a dot of light-reflecting material, said dot of light-reflecting material disposed so as to reflect light energy towards the eye of the user.

12. The firearm sighting system of claim 10, wherein said front sight post further comprises a fiber-optic element, said fiber-optic element disposed so as to collect ambient light energy and channel said ambient light energy towards the eye of the user.

13. The firearm sighting system of claim 10, wherein said front sight post further comprises a fiber-optic element, said fiber optic element configured so as to collect light energy from a light source in electrical communication with a source of electrical power, and to direct said light energy toward the eye of the user.

14. The firearm sighing system of claim 1, wherein said firearm is further defined as a semi-automatic pistol.

15. A firearm sighting apparatus, comprising:

a housing;

a first rear sighting indicator;

a second rear sighing indicator;

an illuminated sighting system comprising a light source in communication with a source of electrical power, said light source emitting a beam of light energy towards an at least partially reflective surface, wherein said at least partially reflective surface reflects at least a portion of a beam of said beam of light energy towards an eye of a user, forming a visible dot on said at least partially reflective surface;

wherein each of said first rear sighting indicator and said second rear sighting indicator comprise a light-gathering element that collects light energy in a light-collecting end and channels the collected light energy toward an eye of a user when said user is attempting to aim said firearm; and said light source, said reflective surface and said first rear sighting indicator and said second sighting indicator are disposed within said housing; and wherein, said first rear sighting indicator and said second sighting indicator, when positioned relative to said visible dot of light energy on said at least partially reflective surface in a predefined spatial relationship, are operable to indicate a direction of travel of a projectile fired by the firearm, or to indicate an expected point of impact of a projectile fired by the firearm.

16. The rear sighting assembly of claim 15, wherein said wherein said light gathering elements are fiber-optic elements.

17. The rear sighting assembly of claim 16, wherein said fiber-optic elements are configured so as to collect ambient light in a light-collecting end.

18. The rear sighting assembly of claim 16, wherein said fiber-optic elements are configured so as to collect light energy from said light source in a light-collecting end.

19. The rear sighting assembly of claim 15, wherein said housing is adapted to be attached to a surface of a firearm in a removable attachment.

20. The rear sighting assembly of claim 19, wherein said removable attachment is by a dovetail attachment or threaded fastener attachment.

21. The firearm sighting system of claim 15, wherein said housing forms an unitary part of a slide of a semi-automatic or automatic pistol.

22. The firearm sighting system of claim 15, wherein said housing forms an unitary part of a structure of a semi-automatic or automatic rifle.

* * * * *